US005589031A

United States Patent [19]

Färnstrand et al.

[11] Patent Number: 5,589,031

[45] Date of Patent: Dec. 31, 1996

[54] CHLORINE DIOXIDE BLEACHING OF CHEMICAL PULP

[75] Inventors: Per-Åke Färnstrand; Lars T. Sjödin, both of Sundsvall; Lars-Åke Lindström, Alnö ; K. Solveig E. Nordén, Njurunda, all of Sweden

[73] Assignee: Sunds Defibrator Industries Aktiebolag, Sweden

[21] Appl. No.: 930,665

[22] PCT Filed: Mar. 7, 1991

[86] PCT No.: PCT/SE91/00178

§ 371 Date: Oct. 2, 1992

§ 102(e) Date: Oct. 2, 1992

[87] PCT Pub. No.: WO91/17306

PCT Pub. Date: Nov. 14, 1991

[30] Foreign Application Priority Data

Apr. 30, 1990 [SE] Sweden ..... 9001548

[51] Int. Cl.[6] ..... D21C 9/14; D21C 9/147; D21C 9/16

[52] U.S. Cl. ..... 162/65; 162/78; 162/88; 162/89

[58] Field of Search ..... 162/65, 89, 88, 162/90, 78

[56] References Cited

U.S. PATENT DOCUMENTS 4,274,912 6/1981 Carles et al. ..... 162/65
4,451,332 5/1984 Annergren et al. ..... 162/65
4,568,420 2/1986 Nonni ..... 162/65
4,657,633 4/1987 Dwiggins ..... 162/65

FOREIGN PATENT DOCUMENTS 81020828 4/1981 Sweden ..... 162/89

OTHER PUBLICATIONS

Powell "Optimization of the (CD)(Eo) bleaching Sequence . . . " *Tappi J.*, Jun. 1988 pp. 49–55.

Althouse "Hydrogen Peroxide Addition to Eo Bleaching Stages Is Beneficial" *Pulp & Paper*, Jun. 1988 pp. 68–70.

W. Howard Rapson et al., "Peroxide or hypochlorite in the E2 stage of CEDED bleaching of draft pulp: effect on shives," Tappi Journal, vol. 66, #8, pp. 77–80.

*Primary Examiner*—Steven Alvo

*Attorney, Agent, or Firm*—Lerner, David, Littenberg, Krumholz & Mentlik

[57] ABSTRACT

A method of bleaching chemical pulp in a sequence comprising at least four bleaching steps with final bleaching in a first and a second chlorine dioxide step. Between the chlorine dioxide steps an alkaline extraction is carried out, and washing takes place between the first chlorine dioxide step and extraction. Immediately after said washing step, NaOH is charged in an amount of 4–10 kg/ton pulp. Thereafter an oxidizing agent is admixed in an amount of at maximum 2 kg/ton pulp. After 15–120 seconds an acid is added for terminating the oxidation treatment and for lowering the pH-value, but without effecting a complete neutralization of residual alkaline.

8 Claims, 1 Drawing Sheet

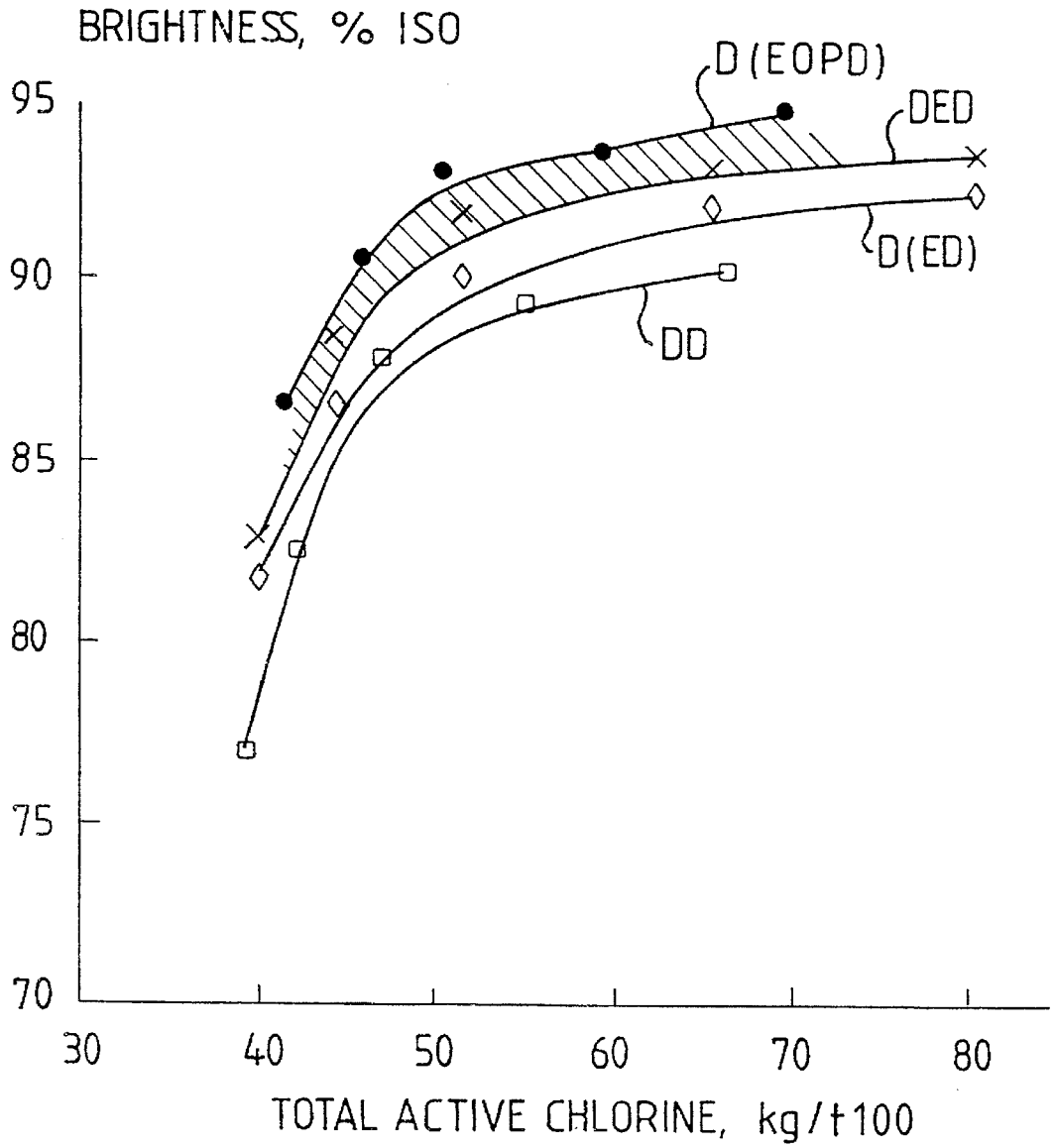
BRIGHTNESS, % ISO
95
90
85
80
75
70
30
40
50
60
70
80
TOTAL ACTIVE CHLORINE, kg/t100
D(EOPD)
DED
D(ED)
DD

CHLORINE DIOXIDE BLEACHING OF CHEMICAL PULP

FIELD OF THE INVENTION

The present invention relates to the bleaching of chemical pulp. More particularly, the present invention relates to the bleaching of chemical pulp in a bleaching sequence which includes at least four bleaching steps, and most preferably where the final bleaching is carried out in a first and a second chlorine dioxide step with an intermediate alkaline extraction therebetween.

BACKGROUND OF THE INVENTION

Multi-step bleaching sequences including four bleaching steps, and in which the final bleaching includes first and second chlorine dioxide steps with an intermediate alkaline extraction can comprise, for example, a first step with chlorine/chlorine dioxide (known as CD), a second step with alkaline extraction in which oxygen gas is added thereto (known as EO), and a final bleaching step using two chlorine dioxide steps (known as D1 and D2, respectively). However, other such bleaching sequences are known, which are finalized using two chlorine dioxide steps with or without an intermediate extraction therebetween. It is known that the alkaline extraction step carried out between the chlorine dioxide steps (D1 and D2) during the final bleaching of a chemical pulp can be simplified, for example, by elimination of the washing of the pulp subsequent to the alkaline treatment step. In that case, however, it was believed necessary to neutralize residual alkali prior to the second chlorine dioxide step (D2). This, however, results in a greater consumption of alkali or chlorine dioxide, since the pH value in the second chlorine dioxide step (D2) will not be at the optimum level.

These and other problems are solved in accordance with the present invention, which results in a surprising and substantial increase in the efficiency of the alkalization, resulting in improved bleaching compared with conventional methods as set forth above.

SUMMARY OF THE INVENTION

In accordance with the present invention, a method for bleaching chemical pulp is provided including subjecting a partially bleached chemical pulp to a final bleaching sequence which includes bleaching the partially bleached chemical pulp in a first chlorine dioxide bleaching step so as to produce a first chlorine dioxide bleached pulp, washing the first chlorine dioxide bleached pulp so as to produce a washed pulp, extracting the washed pulp with alkali in an amount of between about 4 and 10 kg/ton of said pulp so as to produce an alkali extracted pulp including residual alkali therein, oxidizing the alkali extracted pulp by admixing an oxidizing agent such as oxygen gas and/or hydrogen peroxide with the alkali extracted pulp so as to produce an oxidized pulp, adding an acid to the oxidized pulp in order to terminate the oxidizing step and to lower the pH of the oxidized pulp, without effecting a complete neutralization of the residual alkali therein, so as to produce an acid neutralized pulp, and further bleaching the acid neutralized pulp in a second chlorine dioxide bleaching step. Preferably, the partially bleached chemical pulp is produced by an initial bleaching sequence which includes a first chlorine/chlorine dioxide bleaching step and a second alkali extracting step utilizing oxygen gas therein.

In accordance with one embodiment of the method of the present invention, oxidization of the alkali extracted pulp utilizes an amount of up to about 2 kg of the oxidizing agent per ton of the pulp. Preferably, the oxidizing step is carried out at a pressure of between about 0.1 and 1.0 MPa, and most preferably at a temperature of between about 60° and 90° C.

In accordance with another embodiment of the method of the present invention, addition of the acid to the oxidized pulp comprises adding the acid about 15 to 120 seconds after admixture of the oxidizing agent with the alkali extracted pulp.

In accordance with another embodiment of the method of the present invention, addition of the acid to the oxidized pulp comprises adding an amount of the acid to the oxidized pulp expressed in hydrogen ions of up to about NaOH–2/40 kmol $H^+$ per ton of the pulp, wherein NaOH comprises the amount of the alkali added during the extracting step expressed in kilograms of the alkali per ton of the pulp.

In accordance with another embodiment of the method of the present invention, addition of the acid to the oxidized pulp takes place immediately prior to or simultaneously with the further bleaching of the acid neutralized pulp in the second chlorine dioxide bleaching step.

In accordance with another embodiment of the method of the present invention, the oxidizing agent is hydrogen peroxide, and it is admixed with the alkali extracted pulp in an amount of up to about 1 kg per ton of the pulp.

BRIEF DESCRIPTION OF THE DRAWING

The present invention may be understood in greater detail in the following detailed description by reference to a particular embodiment of the present invention, the results of which are shown in FIG. 1, which is a graphical representation plotting the brightness of the pulp expressed in percent ISO against the total consumption of chlorine dioxide ($ClO_2$) in the chlorine dioxide steps expressed in kg active chlorine per ton of pulp (kg act Cl/ton).

DETAILED DESCRIPTION

The bleaching sequence of this invention is conventional to the extent that the pulp is bleached in a first chlorine/chlorine dioxide step, a second alkaline extraction step reinforced with oxygen gas, and a first chlorine dioxide step. However, in accordance herewith, immediately after the washing which is carried out subsequent to this first chlorine dioxide step, 4 to 10, and preferably 4 to 8 kg of NaOH per ton of pulp is charged in an alkali extraction step. Directly thereafter, an oxidizing agent in the form of oxygen gas and/or hydrogen peroxide is admixed with the extracted pulp in an amount of up to about 2 kg/ton of pulp. The oxidizing agent is introduced by means of a pump intended for this purpose, or by use of a mixer of a kind which is well known in the art. When hydrogen peroxide alone is utilized, the amount charged thereto can be limited to about 1 kg/ton of pulp. The admixing of the oxidizing agent with the alkali extracted pulp is carried out at a pressure of from about 0.1 to 1.0 MPa. After a period of about 15 to 120 seconds, and preferably from about 15 to 90 seconds subsequent to addition of the oxygen gas and/or hydrogen peroxide, an acid is added thereto. During this time period, a temperature of from about 60° to 90° C., and preferably from about 50° to 75° C., is maintained.

The acid, for example sulphuric acid ($H_2SO_4$), is added to the oxidized pulp in order to terminate the oxidizing treatment with oxygen gas and/or hydrogen peroxide, and in order to lower the pH value of the oxidized pulp, but in a manner so as not to effect complete neutralization of the residual alkali therein. In order to do so, it is thus required that the amount of acid per ton of pulp, expressed as hydrogen ions, shall amount to a maximum of $$H^+ = \frac{NaOH - 2}{40}$$

kmol $H^+$/ton of pulp, where NaOH is the amount of alkali charged thereto expressed in kg of NaOH per ton of pulp. The addition of acid should preferably be carried out immediately before or simultaneous with the addition of chlorine dioxide in the second chlorine dioxide step (D2).

As can be seen in the Figure, the brightness values obtained vary with the total consumption of $ClO_2$ during the D1 and D2 steps, in this particular case in which coniferous wood sulphate pulp having a Kappa number of 18 is bleached.

Referring again to the Figure, in addition to the curve referring to the invention, D(EOPD), curves are also shown comparing the result of conventional bleaching methods. Curve DD thus refers to a bleaching sequence in which both of the final chlorine dioxide steps are carried out with an intermediate washing step, but without intermediate alkali extraction. Curve DED, on the other hand, refers to a bleaching sequence in which a conventional alkali extraction step is carried out between the two chlorine dioxide steps, and in which a washing step is carried out both before and after the extraction step, curve D(ED) refers to a bleaching sequence in which no washing step is carried out between the extraction step and the second chlorine dioxide step (D2). The bleaching conditions utilized in each of these cases are, in all other respects, equivalent. The first bleaching step was carried out utilizing a combination of chlorine and chlorine dioxide, and the second bleaching step was an alkali extraction step reinforced with oxygen gas.

Referring once again to the Figure, the cross-hatched area represents the improvement which can be obtained with the method according to the present invention, as compared to the known art. It thus appears from the Figure that, according to the invention, a certain degree of brightness can be achieved while at the same time consuming considerably less chemicals. Alternatively, a higher brightness can be achieved with a specified degree of chemical consumption.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method of bleaching chemical pulp comprising: subjecting a partially bleached chemical pulp to a final bleaching sequence which includes bleaching said partially bleached chemical pulp in a first chlorine dioxide bleaching step so as to produce a first chlorine dioxide bleached pulp, washing said first chlorine dioxide bleached pulp so as to produce a washed pulp, extracting said washed pulp with an alkali in an amount of between about 4 and 10 kg/ton of said pulp so as to produce an alkali extracted pulp including residual alkali therein, oxidizing said alkali extracted pulp by admixing an oxidizing agent selected from the group consisting of oxygen gas and hydrogen peroxide with said alkali extracted pulp so as to produce an oxidized pulp, addin an acid to said oxidized pulp in order to terminate said oxidizing step and to lower the pH of said oxidized pulp, without affecting a complete neutralization of said residual alkali therein by adding an amount of said acid to said oxidized pulp such that $H^+$ (kmol $H^+$/ton of pulp)=(X–2)/40 wherein X is the amount of said alkali added during said extracting step expressed in kilograms of said alkali per ton of said pulp so as to produce an acid neutralized pulp, and further bleaching said acid neutralized pulp in a second chlorine dioxide bleaching step.

2. The method of claim 1 wherein said partially bleached chemical pulp is produced by an initial bleaching sequence including a first chlorine-chlorine dioxide bleaching step and a second alkali extracting step utilizing oxygen gas therein.

3. The method of claim 1 wherein said oxidizing of said alkali extracted pulp utilizes said oxidizing agent in an amount of up to about 2 kg of said oxidizing agent per ton of said pulp.

4. The method of claim 3 wherein said oxidizing of said alkali extracted pulp is carried out at a pressure of between about 0.1 and 1.0 MPa.

5. The method of claim 3 wherein said oxidizing of said alkali extracted pulp is carried out at a temperature of between about 60° and 90° C.

6. The method of claim 1 wherein said adding of said acid to said oxidized pulp comprises adding said acid about 15 to 120 seconds after said admixing of said oxidizing agent with said alkali extracted pulp.

7. The method of claim 1 wherein said adding of said acid to said oxidized pulp takes place immediately prior to or simultaneous with said further bleaching of said acid neutralized pulp in said second chlorine dioxide bleaching step.

8. The method of claim 1 wherein said oxidizing agent comprises hydrogen peroxide, and wherein said hydrogen peroxide is admixed with said alkali extracted pulp in an amount of up to about 1 kg per ton of said pulp.

* * * * *

UNITED STATES PATENT AND TRADEMARK OFFICE
CERTIFICATE OF CORRECTION

PATENT NO. : 5,589,031

DATED : December 31, 1996

INVENTOR(S) : Färnstrand et al.

It is certified that error appears in the above-identified patent and that said Letters Patent is hereby corrected as shown below:

Column 2, line 16, "NaOH-2/40" should read:

-- $\frac{\text{NaOH-2}}{40}$ --

Column 3, line 32, there should be a period after the word "step". (delete the comma)

Column 4, line 17, "addin" should read --adding--.

Signed and Sealed this

Sixth Day of May, 1997

*Attest:*

Bruce Lehman

BRUCE LEHMAN

*Attesting Officer*

*Commissioner of Patents and Trademarks*